US007253998B2

(12) United States Patent
Cecconi

(10) Patent No.: US 7,253,998 B2
(45) Date of Patent: Aug. 7, 2007

(54) STARTING AND PROTECTION DEVICE, IN PARTICULAR FOR REFRIGERATOR MOTORS, FITTED WITH A SHAPED CASING SO AS TO KEEP THE PROTECTOR SEPARATE FROM THE OTHER COMPONENTS

(75) Inventor: Pietro Cecconi, Monza (IT)

(73) Assignee: Electrica S.r.L., Milan (IT)

( * ) Notice: Subject to any disclaimer, the term of this patent is extended or adjusted under 35 U.S.C. 154(b) by 440 days.

(21) Appl. No.: 10/885,647

(22) Filed: Jul. 8, 2004

(65) Prior Publication Data

US 2005/0198988 A1 Sep. 15, 2005

(30) Foreign Application Priority Data

Mar. 9, 2004 (IT) ..... PC20040005 U

(51) Int. Cl.
*H02H 7/08* (2006.01)

(52) U.S. Cl. ..... 361/22; 318/23; 318/25

(58) Field of Classification Search ..... 361/22, 361/23, 25

See application file for complete search history.

(56) References Cited

U.S. PATENT DOCUMENTS

| | | | | | |
|---|---|---|---|---|---|
| 4,084,202 | A | * | 4/1978 | Stoll | 361/24 |
| 4,237,510 | A | * | 12/1980 | Thompson et al. | 361/24 |
| 4,467,385 | A | * | 8/1984 | Bandoli et al. | 361/24 |
| 4,646,195 | A | * | 2/1987 | Lisauskas | 361/25 |
| 4,701,824 | A | * | 10/1987 | Beggs et al. | 361/24 |
| 6,122,154 | A | * | 9/2000 | Damerow et al. | 361/32 |

* cited by examiner

*Primary Examiner*—Rita Leykin
(74) *Attorney, Agent, or Firm*—Young & Thompson

(57) ABSTRACT

A starting and protection device for refrigerator motors having a thermal protection device and a PTC resistor, includes a common casing containing the protector and the PTC resistor. The casing is formed by two separate bodies designed to house the protector and the PTC resistor respectively. The bodies are separate and distanced to prevent the protector from being affected by the heat developed by resistor.

4 Claims, 3 Drawing Sheets

STARTING AND PROTECTION DEVICE, IN PARTICULAR FOR REFRIGERATOR MOTORS, FITTED WITH A SHAPED CASING SO AS TO KEEP THE PROTECTOR SEPARATE FROM THE OTHER COMPONENTS

This invention relates to a starting and protection device, in particular for refrigerator compressor motors, of the type comprising a PTC resistor and a protective device, both inserted in a casing fitted with connectors which enable it to be connected to the standardised pins present on compressors, and with connectors which allow the subsequent application of a capacitor.

The device according to the invention is characterised by the particular configuration of the casing, which is designed to keep the protector separate and distanced from the PTC resistor.

In particular, the casing of the device comprises two seatings constituted by projecting box-shaped bodies, designed to house the PTC resistor and the protector respectively, the first of which said bodies is designed to be inserted into the bracket present on the compressor to allow the application of the device to the motor connection pins, while the second body remains outside said bracket when the device is fitted.

The protector thus remains entirely separate from the PTC resistor, with the result that it is unaffected by the heat developed by that resistor.

Connectors are also fitted to the body where the PTC resistor is located, allowing the application of a start or run capacitor from the outside.

In refrigerators, the motor and compressor are usually made in a single unit, enclosed in a sealed casing which has a standardised connector for the connections to the power line.

This standardised connector is constituted by three pins mounted on a support applied to the casing of the unit, and is usually surrounded by a bracket which acts as housing/guide for the starter device.

In the most recent versions, the starter comprises a protective device which cuts off the electricity supply if the temperature exceeds a pre-determined value, a PTC resistor, and a start or run capacitor.

U.S. Pat. No. 6,356,047, filed by the same applicant, describes a starting device which consists of a PTC resistor in series with a relay, both of which are housed in a single L-shaped box container so that a protection device can be inserted in the free space without increasing the overall size of the assembly.

The device thus configured can be installed on the compressor merely by attaching it to the standardised connector, and the container is housed inside the compressor bracket.

U.S. Pat. No. 6,456,470, filed by the same applicant, describes a starting device for compressors of the type comprising a PTC resistor and a protection device, both of which are inserted in a casing fitted with couplings designed for connection to the standard coupling pins present on compressors, which said device is characterised in that it also incorporates a start capacitor or a run capacitor in the same casing.

The casing is fitted with a connector designed for connection to said pins so that the assembly can be fitted simply by inserting the device into the bracket, the casing being snap-fitted into its seating where it remains firmly coupled to the three pins as a result of the grip of its female connectors, in such a way as to eliminate the risk of its becoming disconnected even as a result of the vibrations transmitted by the compressor motor.

The present invention, which falls into this sector, relates to a starting device wherein only the PTC resistor and the protective device are housed inside the casing, which is fitted with a connector for coupling to an external capacitor.

In recent years, the manufacturers of these devices have tended to reduce their overall size and house all the components, ie. the protective device, PTC resistor and electrical connections, in a casing which is small enough to be housed inside the bracket where the pins for connection to the power supply are located.

This solution, which guarantees the stability of the device and eliminates problems due to vibrations, is quite practical, but can present drawbacks in some cases.

The PTC resistor develops a certain amount of heat which can cause the protective device to come into operation, because in view of the small size of the assembly, the protective device is almost in contact with the PTC.

In some cases, especially with some types of motor, shutdowns may therefore occur even in the absence of malfunctions because the protector detects the heat developed by the PTC, or the protector may fail to detect a malfunction as quickly as it should because it is masked by the heat generated by the PTC, which is fitted too close to it.

The present invention eliminates this drawback by offering a starting and protection device for refrigerator motors wherein the casing presents two separate seatings, one for the PTC and the other for the protector, and is shaped in such a way that when it is fitted to the compressor bracket one of said seatings, in particular the one containing the protector, remains outside the bracket, so that the protector is separate from the PTC and consequently not exposed to the effects of the heat developed by it.

This invention will now be described in detail, by way of example but not of limitation, by reference to the annexed figures wherein.

Figure 1:
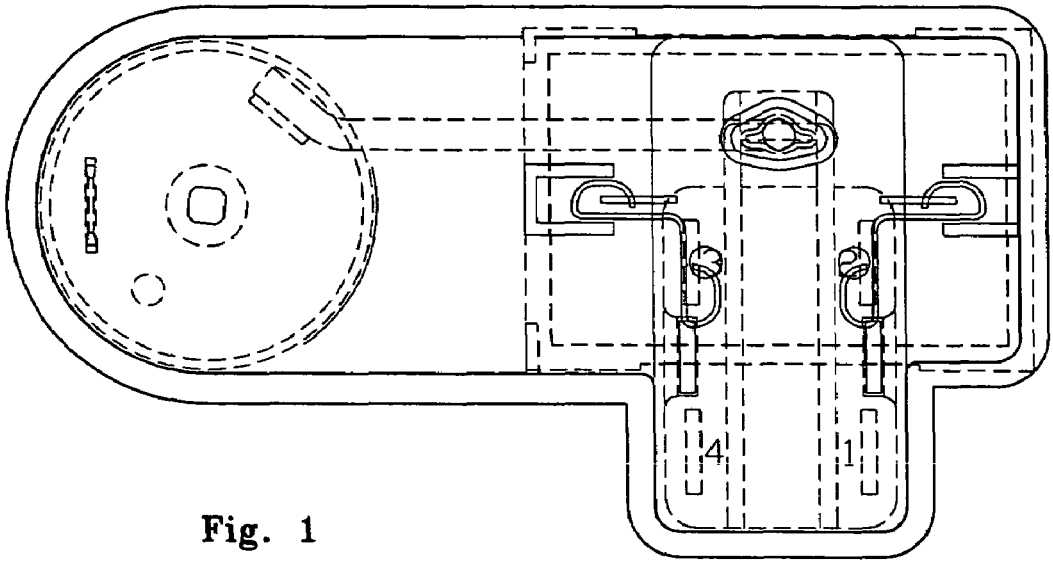
FIG. 1 is a plan view of a device according to the invention, assembled.
Figure 1A:
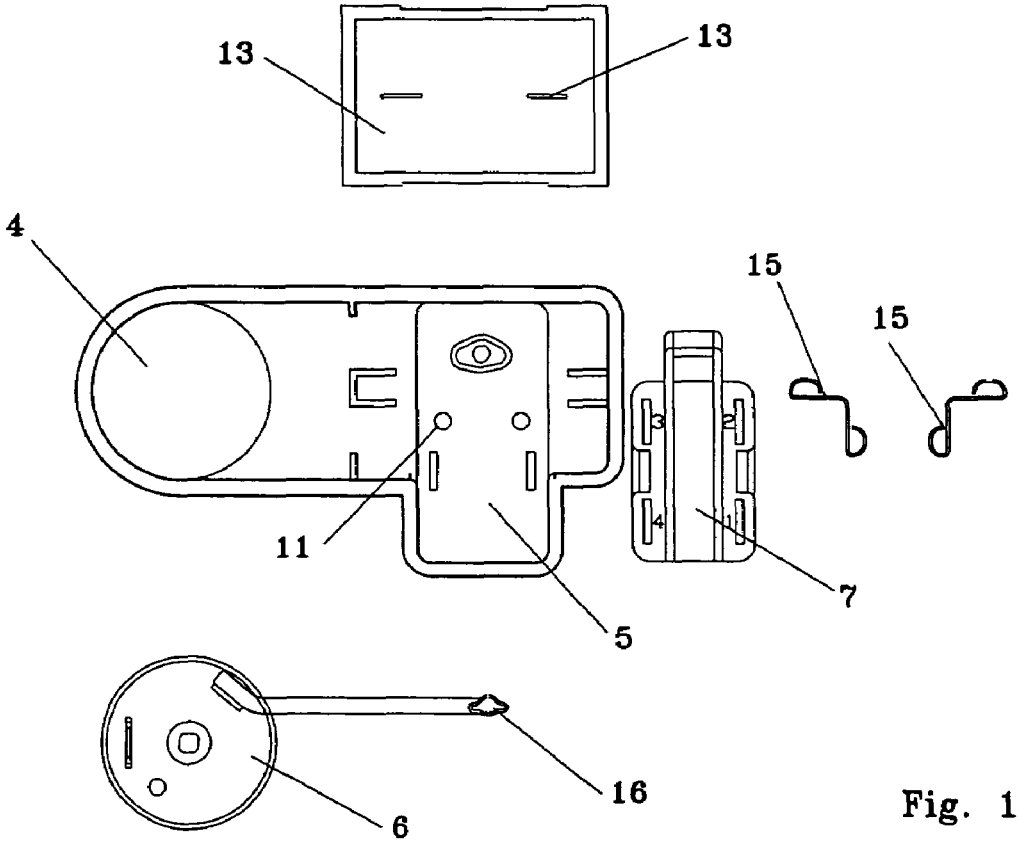
Figure 2:
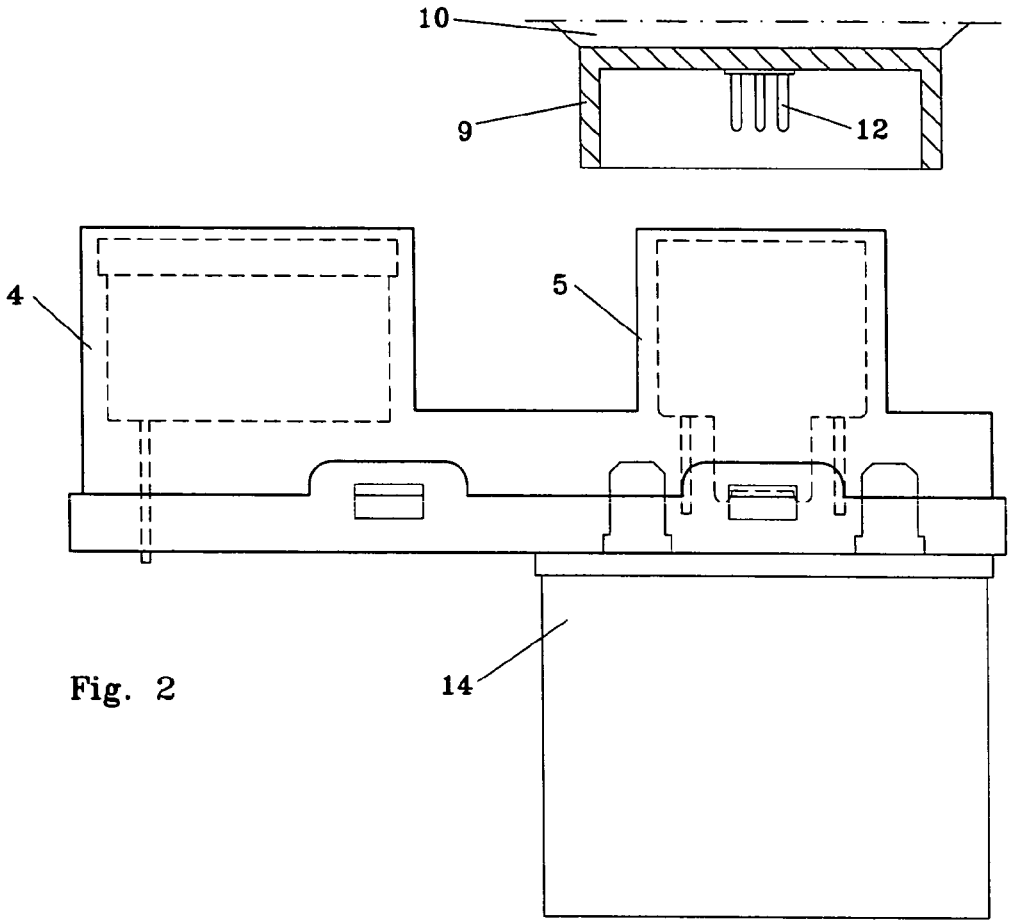
FIG. 2 is a front view of the device shown in FIG. 1.
Figure 2A:
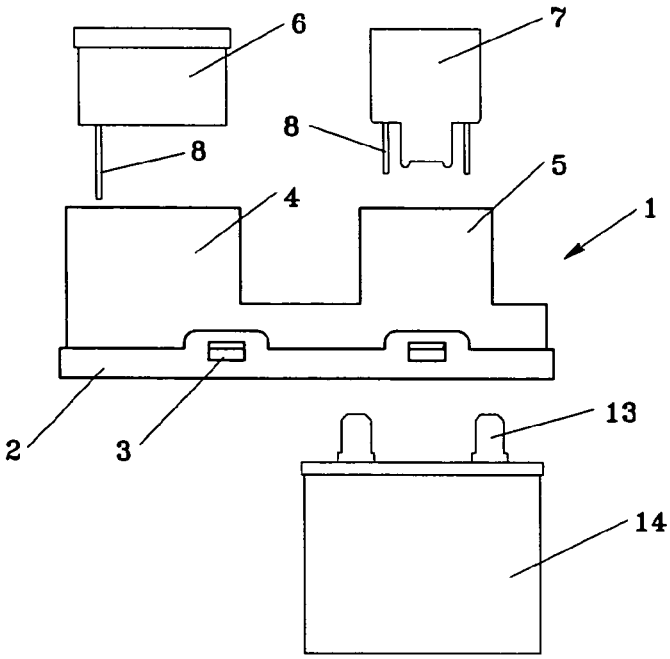
Figure 3:
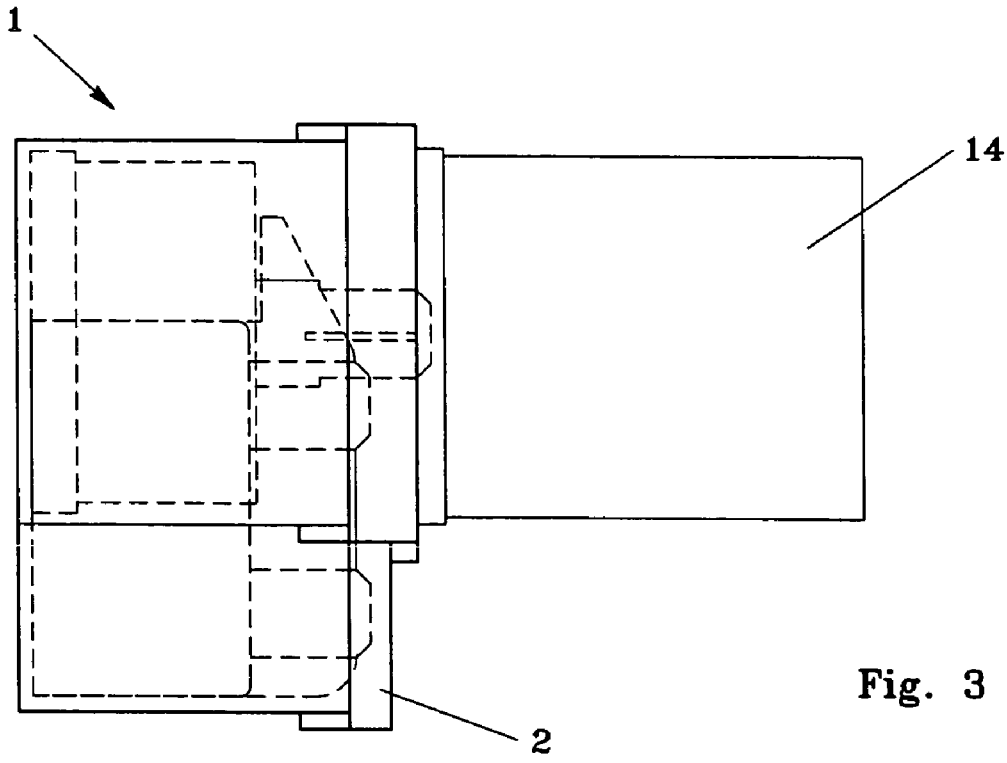
FIG. 3 is a side view of the same device.
Figure 3A:
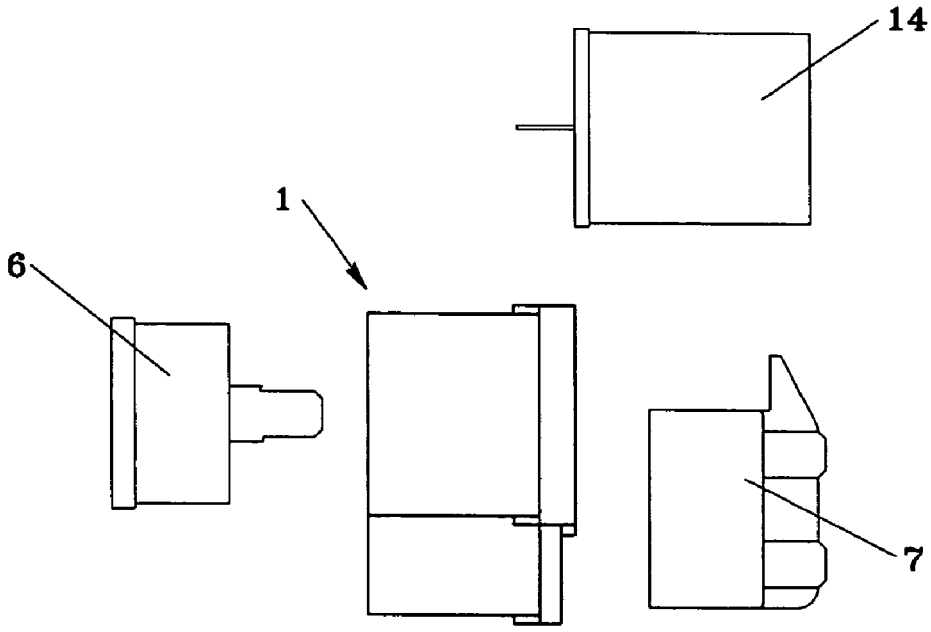

FIGS. 1*a*, 2*a* and 3*a* are three views of a device corresponding to those shown in FIGS. 1, 2 and 3 respectively, with the components removed from the container, in order to illustrate the configuration of the latter more clearly.

The starting device according to the invention comprises a casing assembly 1, designed to house the various components, which is closed by a lid 2 that snaps onto body 1 where it is secured by teeth 3.

Body 1 is shaped so as to define a pair of box-shaped seatings 4 and 5, which are designed to house a protection device 6, and a PTC resistor with support 7, respectively.

Each of said components is fitted with faston connectors 8, which project from the container when the device is assembled so that power cables can be attached.

A characteristic feature of the invention is that bodies 4 and 5 which constitute the seatings for the protector and the resistor are separate and sufficiently spaced, so that the heat developed by the PTC resistor cannot reach protector 6 or affect its operation.

When the device has been assembled, body 4 in which the protector is housed preferably remains outside bracket 9 in which body 5 is inserted to fit the device to compressor 10, as shown in FIG. 2.

The base of body 5 contains holes 11 for the passage of the pins 12 to which the device is connected, and there are openings on the lid, not shown in the figure, for the passage of contacts 13 of a capacitor 14 which is fitted to the device after it has been assembled.

In accordance with an advantageous aspect of the invention, capacitor 14 is fitted substantially in axis with PTC resistor 7 and pins 12, so that when pressure is exerted to fit it to the device, the thrust is discharged directly onto the base of bracket 9 without creating bending moment, as occurs with other known devices in which the capacitor is fitted out of axis with the pins.

Said capacitor position, in axis with the connection and fixing pins, is even more efficient during operation of the compressor, limiting its oscillations due to the effect of the shorter connection arm and reducing the risk that the capacitor may exit from its seating and become disconnected.

The device is completed by contacts 15 and 16 which connect the various components to one another.

As will appear clearly from the annexed figures, the use and in particular the assembly of the device according to the invention are extremely simple.

It is sufficient to insert the box containing PTC resistor 7 into body 5 and protector 6 into body 4, position contacts 15 by inserting them into the guides in container 1, and close the container by snap-fitting lid 2.

The device can be fitted to the compressor simply by coupling it to pins 12. Body 5 penetrates into bracket 9, while body 6 is positioned outside said bracket, remaining separate and distanced from the PTC.

As a result, little if any of the heat developed by said resistor can reach the protector, and its operation is unaffected.

If required, a start capacitor or run capacitor can be fitted by inserting contacts 13 through the openings in lid 2, until they engage with internal contacts 15 which connect the capacitor to the other components.

The device according to the invention, which has an extremely simple design, is particularly useful because it eliminates the risk of protector malfunction caused by the heat developed by the PTC resistor.

The sizes and the materials used can obviously vary, depending on requirements.

The invention claimed is:

1. Starting and protection device for refrigerator motors of the type comprising a thermal protection device and a PTC resistor, characterised in that it comprises a common casing (1) containing said protector (6) and said PTC resistor (7), which said casing is formed by two separate bodies (4, 5) designed to house the protector and the PTC resistor respectively, which said bodies are separate and distanced to prevent said protector (6) from being affected by the heat developed by resistor (7), wherein said casing (1) is formed by bodies (4, 5) designed to house the protector (6) and the PTC resistor (7), which are separated by a distance such that when the device is fitted to the compressor, one of bodies (4, 5) is located inside the compressor support bracket (9) and the other is located outside said bracket.

2. Starting and protection device as claimed in claim 1, characterised in that said casing (1) has a first projecting body (5) designed to house the PTC resistor (7), fitted with openings (11) for coupling to standardized pins (12) present on the compressors, and a second projecting body (4) designed to house the protector (6), which said second body (4) is located at such a distance from body (5) that when the device is fitted to the compressor, said body (4) remains outside the support bracket (9) which surrounds the pins to which the device is coupled.

3. Starting and protection device as claimed in claim 2, characterised in that it includes connectors for the fitting of an external start capacitor or run capacitor (14).

4. Starting and protection device as claimed in claim 3, characterised in that said connectors for the fitting of an external capacitor (14) are arranged in such a way that the capacitor is positioned substantially in axis with the PTC resistor (7) and the compressor pins (12).

* * * * *